US007861567B2

(12) United States Patent
Chang et al.

(10) Patent No.: US 7,861,567 B2
(45) Date of Patent: Jan. 4, 2011

(54) METHOD AND APPARATUS TO CONTROL THE LATERAL MOTION OF A LONG METAL BAR BEING FORMED BY A MECHANICAL PROCESS SUCH AS ROLLING OR DRAWING

(75) Inventors: Tzyy-Shuh Chang, Ann Arbor, MI (US); Hsun-Hau Huang, Ann Arbor, MI (US); Chang-Hung Lin, Ypsilanti, MI (US)

(73) Assignee: OG Technologies, Inc., Ann Arbor, MI (US)

( * ) Notice: Subject to any disclaimer, the term of this patent is extended or adjusted under 35 U.S.C. 154(b) by 592 days.

(21) Appl. No.: 11/846,303

(22) Filed: Aug. 28, 2007

(65) Prior Publication Data

US 2008/0073401 A1 Mar. 27, 2008

Related U.S. Application Data

(63) Continuation-in-part of application No. 11/284,508, filed on Nov. 22, 2005, now Pat. No. 7,275,404.

(51) Int. Cl.
*B21B 39/20* (2006.01)
*B21D 43/08* (2006.01)
*B65H 57/00* (2006.01)

(52) U.S. Cl. ..... 72/250; 72/428; 242/615.2; 242/615.3

(58) Field of Classification Search ..... 72/250, 72/251, 428, 252.5; 226/189, 196.1; 242/615, 242/615.1, 615.2, 615.3, 615.4; 198/628, 198/608, 611, 612
See application file for complete search history.

(56) References Cited

U.S. PATENT DOCUMENTS

| | | | | |
|---|---|---|---|---|
| 2,300,359 | A * | 10/1942 | Mohan | 198/624 |
| 3,014,628 | A | 12/1961 | Littlehale | |
| 3,793,868 | A | 2/1974 | Wilson | |
| 4,121,446 | A | 10/1978 | Passoni et al. | |
| 4,343,167 | A | 8/1982 | Hasegawa et al. | |
| 4,413,494 | A | 11/1983 | Gilvar et al. | |
| 4,559,990 | A | 12/1985 | Greilinger et al. | |
| 4,635,861 | A | 1/1987 | Resch | |
| 5,743,127 | A | 4/1998 | Takeda et al. | |
| 6,920,772 | B1 | 7/2005 | Shore et al. | |

* cited by examiner

*Primary Examiner*—Debra M Sullivan
(74) *Attorney, Agent, or Firm*—Dykema Gossett PLLC

(57) ABSTRACT

An apparatus to control lateral motion of a bar moving along a guidance path includes a pair of rotatable hubs each having at least first and second rollers at locations around the perimeter of the hub. The first roller has a first retaining groove of a first radius and the second roller has a second groove of a second radius smaller than the first radius. Each hub further includes at least one guiding element located between the rollers with a guide channel extending in the outer surface. A mounting system allows the hubs to be rotated between first and second positions. In the first position the first rollers oppose each other forming a guideway having a first, enlarged diameter for capturing a free end of an approaching bar. In the second position the second rollers form a second, smaller diameter to match the actual size of the bar.

17 Claims, 15 Drawing Sheets

Figure 10A
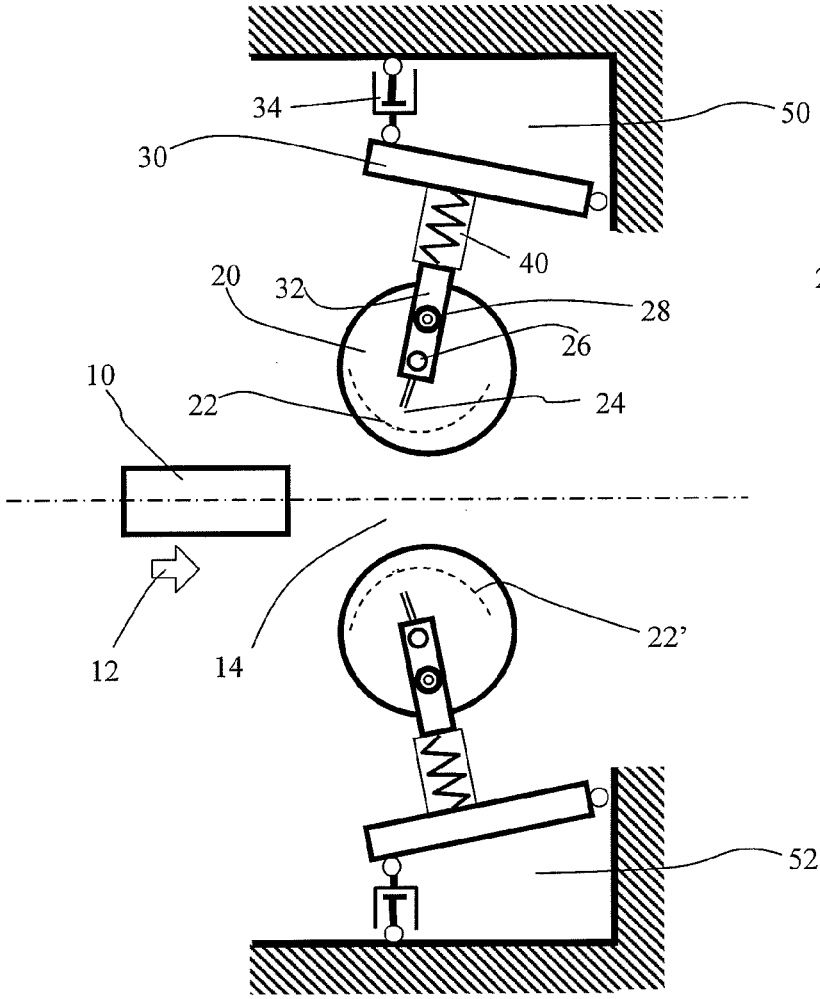
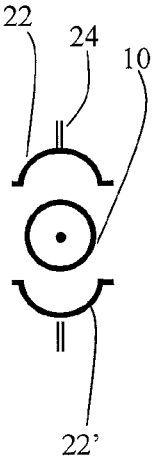
Figure 10B

METHOD AND APPARATUS TO CONTROL THE LATERAL MOTION OF A LONG METAL BAR BEING FORMED BY A MECHANICAL PROCESS SUCH AS ROLLING OR DRAWING

CROSS-REFERENCE TO RELATED APPLICATIONS

This application is a continuation-in-part (CIP) of U.S. application Ser. No. 11/284,508 filed 22 Nov. 2005, now U.S. Pat. No. 7,275,404, which is hereby incorporated by reference herein in its entirety

STATEMENT REGARDING FEDERALLY SPONSORED RESEARCH OR DEVELOPMENT

This invention was made with United States government support under Cooperative Agreement No. DE-FC36-GO14003 "SQA™ SURFACE QUALITY ASSURED STEEL BAR PROGRAM" awarded by the Department of Energy. The United States government has certain rights in the invention.

BACKGROUND OF THE INVENTION

1. Technical Field

The present invention relates generally to a device to control the motion of a long product, such as a steel bar or rod, moving with high linear speed, in a manufacturing process, such as rolling.

2. Discussion of the Background Art

Certain manufacturing processes, such as rolling, drawing and extrusion are utilized to reduce the cross sectional dimensions of metal products through mechanical contact between the metal workpiece and different tools such as rolls and dies. These manufacturing processes are continuous, or substantially continuous, processes and are herein collectively referred to as "reducing processes." This invention applies to metal products that are commonly referred to as long products or bars and/or rods. These metal products move along a longitudinal axis in a manufacturing process and will be referred to hereinafter as a "bar" or "bars."

A bar is different than a metal slab, bloom or strip, all of which are known as flat products. The cross section of a bar has a smaller circumference/cross-section-area ratio than flat products and the bar may rotate/twist about its longitudinal axis while moving forward longitudinally. The bar shapes shown in FIG. 2, for example, have a ratio of circumference to cross-section equal to or smaller than 4.25 when the cross sectional area is unity for the given shape. The shapes of the cross-section of a metal bar shown in FIG. 2 include round, oval, or polygonal.

In the hot rolled steel industry, the length to circumference ratio of the bar after it is reduced is typically over 10 and the length to cross-section critical dimension, such as the diameter of a round bar, is over 30 Furthermore, the bar frequently travels through the reducing process at high speed and high temperature.

The manufacturing process is designed to move the bar along a predetermined, ideal path line (herein referred to as the "bar path") through various reducing mechanisms that apply the appropriate mechanical reducing forces to the bar in a controlled, consistent manner. It is desirable to constrain the bar to the bar path by controlling the bar's non-axial motion (herein referred to as "non-axial motion") as it moves along the bar path through the reducing mechanisms.

A single hot steel rolling line normally produces bars with a range of different diameters. For example, a single hot rolling bar mill could produce bars with diameters ranging from 5 mm to 25 mm. The cost of changing the line to produce a bar with a different diameter from the one currently being rolled is partly a function of the number of different pieces of equipment that have to be changed in order to produce the new diameter.

Guides. Steel mills use devices (herein referred to as "guides") to control the bar's motion. The guides have a guidance path (herein referred to as the "guidance path") that acts to constrain the motion of the bar and force it onto the bar path. The diameter of the guidance path cannot be either smaller, or much larger, than the diameter of the bar or the guide will not function properly. In short, the diameter of the guidance path and the diameter of the bar must closely match each other so that there is a proper fit between the bar and the guide to insure proper functionality of the guide.

When the mill decides to roll a new bar having a diameter smaller than the diameter of the guidance path on the existing guides, the mill must exchange the existing guides for different guides having a guidance path diameter matching the diameter of the new bar.

To reduce the cost and time required to roll different bar sizes, mills use guides that have a guidance path that is large enough to accommodate a range of bar diameters. This permits one guide to handle more than one size bar and therefore minimizes the number of times the mill must exchange guides. However, mills must make a difficult trade-off to both minimize costs and maintain productivity and quality.

If the size range of the guide is too narrow, more guide changes will be required and there will be a greater possibility of undesirable scratches on the bar surface from contact between the bar and the guide. But, if the size range is too wide, a guide will not be function well and undesirable bar motion will occur.

Furthermore, if the leading end of the bar is not aligned with the guidance path ("bar misalignment") when the bar enters the guide, the bar will physically collide with the guide. A collision between the bar and the guide significantly increases the amount of friction on the bar, causing the leading end to lose momentum. At the same time that the leading end slows, the rear part of the bar continues to move at the original bar speed. This creates stress on the inside of the bar. Not infrequently, the bar buckles as a consequence. If the bar buckles, the linear motion of the bar stalls. In hot rolled bar mills, this buckling phenomenon is referred to as a "cobble."

Cobbles can also occur if the leading end of the bar is not properly aligned with the entry to the subsequent device, such as a roll stand or a guide, when the bar approaches the subsequent device. This can result in a collision between the bar and the device. When the bar collides with the device, it can buckle and result in a cobble. Cobbles are wasteful and can be dangerous to both personnel and equipment located near the cobble event because of the heat, motion and mass of the bar.

The quality of the surface finish of a bar can be very important to the end-user of the bar product. Many users pay a premium price for bar with high surface quality. Instruments such as eddy current and optical sensors are used in-line at bar mills for quality assurance to detect surface defects on bar as it is being produced. The amount of non-axial motion of the bar affects the detection capability of these sensor devices. Therefore, to enable both eddy current and optical sensors to operate more effectively, guides are used in front of these sensors to minimize the amount of the non-axial movement of the bar.

In order for the guide to function properly, it must first physically capture the leading end of the bar ("leading end") as it approaches and enters the guide and second it must direct the leading end onto the guidance path. If the opening to the guide is relatively small, the leading end of the bar may not line up properly with the opening and the bar may cobble. To avoid the potential of cobbling, some existing art employs active control systems to control the guides to capture the leading end of the bar. These systems allow the guides to be disengaged from the bar path by actuators, such as pneumatic arms, when the leading end approaches the entry to the guide. Once the leading end is in the guide, the actuators bring the guide into position and engage the guide with the bar. Even with this technique, the guides may still need to be changed frequently to accommodate the tolerances required by different bar sizes.

Prior art involves a number of different guide designs meant to accomplish some, or all, of the following objectives: (1) to capture the leading end of the bar and (2) to constrain the non-axial motion of the bar. Prior art also frequently attempts to minimize the friction between the bar and the guide and to cool the guide. These guides have a guidance path with a constant diameter.

The simplest guide is a one-piece design illustrated in FIG. 3. The guide 120 is used to constrain the motion of the bar (FIG. 3, item 10), traveling from left to right through the guide. This diameter (FIG. 3, item 122) must be large enough to accommodate the bar being processed but small enough that the bar moves in the desired manner along the bar path. The guide has an opening that is larger than the guidance path. The inlet angle θ (FIG. 3, item 124) is typically set between 15° and 30° such that the leading end of the bar can be forced onto the desired bar path. One or more such guides can be arranged together to function in tandem. The bar is forced by the guide opening to move onto the desired bar path. This design is efficient at capturing the leading end of the bar and at constraining the non-axial motion of the bar, but does not efficiently minimize the friction between the bar and the guide. Further, these guides are not always easy to align and may not be easy to inspect and maintain due to the limited visual access to their inner diameter surfaces.

A second type of guide has a fixed lower portion and a re-movable upper portion, item 120' in FIG. 4. The parting line (FIG. 4, item 126) divides the upper and lower portions of the guide. A mechanism, such as a C clamp, is employed to lock the two pieces together to form the guide. The re-moveable upper portion of the guide permits access for maintenance and inspection purposes. In addition, the fixed lower portion typically incorporates a water system to cool the guide. One or more such guides can be arranged together to function in tandem. These guides have an opening that is larger at the front end to efficiently capture the leading end of the bar and force the bar to move onto the bar path. However, this second type of guide does not efficiently minimize the friction between the bar and the guide and it is still necessary to change guides to accommodate different bar sizes.

A third type of guide, illustrated in FIG. 5, uses two or more roll shaped guides, operating in combination. The guides, item 208, have retaining grooves shown as item 210, which have fixed radii. The sum of the radii of the said retaining grooves equals to diameter of the guidance path formed by the retaining grooves. The guides are mounted on supporting arms, item 206. The guides can rotate on their axles, item 212. Mechanical bearings support the said axles allowing them to rotate easily in order to minimize the friction between the bar and the guides. The supporting arms are mounted to the ground structure, item 200, through supporting joints, item 202.

The supporting arms can be manipulated through actuators, item 204 to change the position of the guides relative to the approaching bar (item 10). This type of guide can be opened up (FIG. 5A, item 214) to capture the leading end of the bar, then closed (FIG. 5B, item 214') once the bar is in the guide.

This guide design allows for water-cooling the guides and for easier maintenance.

The current art guide designs force the mill operator to make a tradeoff between functionality, i.e. controlling the motion of the bar, and the cost of such functionality, i.e. deciding on the number of guide exchanges that need to be made to achieve such functionality. Guide exchanges take time and require labor. The more guide exchanges required, the higher the mill's operating costs. Closer tolerances between the diameter of the guidance path and the diameter of the bar enhance the guide's functionality. Closer tolerances mean that the guide better serves its main purpose of controlling the motion of the bar. However, if the tolerance is very tight, the mill will have to exchange guides more frequently, and incur more costs, whenever it changes the size of the bar being processed. On the other hand, if the tolerance is set too loose in order to minimize the need for guide exchanges and hence costs, the non-axial motion of the bar will not be as well constrained and the functionality of the guide will be compromised.

In addition, prior art is based on applying force through contact between the guide and the bar to control the non-axial motion of the bar. Such contact, particularly when there is high bar speed and tight bar diameter constraints, has the potential to negatively affect the surface quality of the bar being rolled.

It is one object of the present invention to overcome one or more of the aforementioned problems associated with existing approaches to control the bar's non-axial motion and to force the bar onto a predetermined bar path.

SUMMARY OF THE INVENTION

In one embodiment, the present invention is a guide, comprised of two or more rotatable retaining elements. The said retaining elements have variable retaining groove radii. The radii of the retaining grooves combine to form a guidance path with a variable diameter. In a second embodiment variable radii of retaining grooves can be a revolver comprised of multiple independent rollers with a variable radius of groove. The diameter of the guidance path can be determined for each particular orientation or rotation angle of the retaining elements.

The invention is intended for use in a manufacturing process, such as hot steel bar rolling, to control the bar's non-axial motion and constrain the bar to a predetermined bar path. The position of each of the said retaining elements relative to each other and to the bar path is designed to properly align the bar with the desired bar path. The invention in the first embodiment includes a bearing, comprised of a media such as compressed air, oil or water, to support the bar as it travels through the guide and to prevent the bar from coming in contact with the surface of the guide.

In the second embodiment, a revolver-style apparatus includes a pair of rotatable hubs each having at least first and second rollers situated at locations around each hub's perimeter. The first roller has a first retaining groove of a first radius and the second roller has a second groove of a second radius smaller than the first radius. Each hub further includes at least one guiding element located between the rollers with a guide channel extending in the outer surface. A mounting system allows the hubs to be rotated between first and second positions. In the first position, the first rollers oppose each other forming a guideway having a first, enlarged diameter particularly suited for capturing a free end of an approaching bar. In the second position, the second rollers form a second, smaller diameter guideway which is selected to match the actual size of the bar. Thus the second embodiment includes a set of rollers with different groove radii being mounted on a rotary hub and arranged in such a way that the groove radii be incrementally increase or decrease when the hub rotates to form a retaining guide of different apertures.

The unique advantages of the present invention are as follows: First, it eliminates the need to physically exchange one guide for a different sized guide during a bar size change. Rotating the retaining elements causes the radii of the retaining grooves, and hence the diameter of the guidance path, to change. The mill operator can determine the guidance path diameter desired and then rotate the said retaining elements to the appropriate orientation where their radii form a guidance path matched to the desired diameter. Rotating the guide accomplishes the same thing as does physically changing guides, namely it changes the diameter of the guidance path. Second, the invention in one embodiment, may employ a bearing, comprised of a media such as compressed air, or water, to prevent physical contact between the guidance path and the bar. This bearing eliminates or reduces a source of surface damage to the bar. Third, the non-contact bearings in the first embodiment may be replaced by traditional rollers arranged as a revolver, in the second embodiment, comprised of small independent rollers with variable groove radii to support the bar as it travels through the guide and to control the bar from free vibration.

BRIEF DESCRIPTION OF DRAWINGS

FIGS. 10A-10B are cross-sectional side and front views showing, in a first embodiment, the guide in a disengaged (i.e., open) orientation to receive the approaching bar end.

DETAILED DESCRIPTION OF THE PREFERRED EMBODIMENTS

Figure 1:
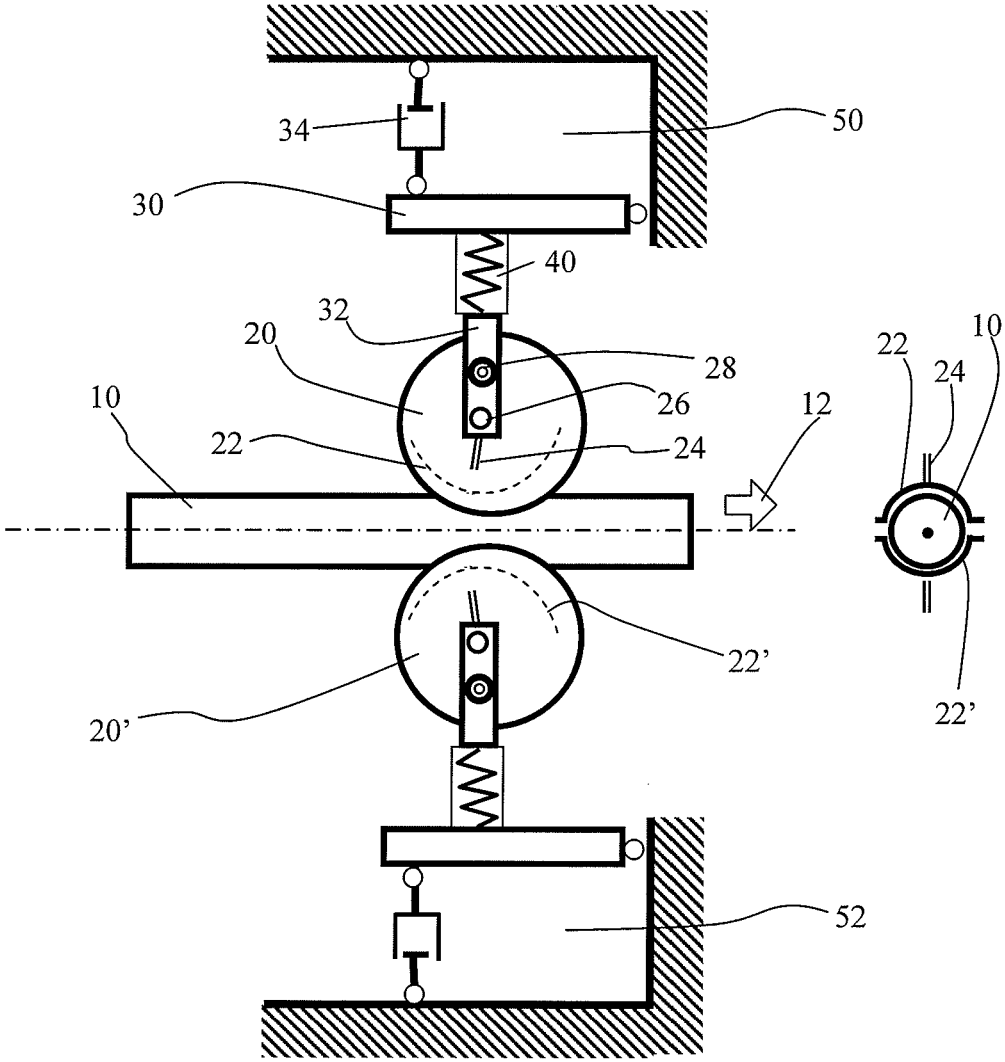
FIG. 1 is a diagrammatic view showing a first embodiment of the present invention guiding a bar.
Figure 2:
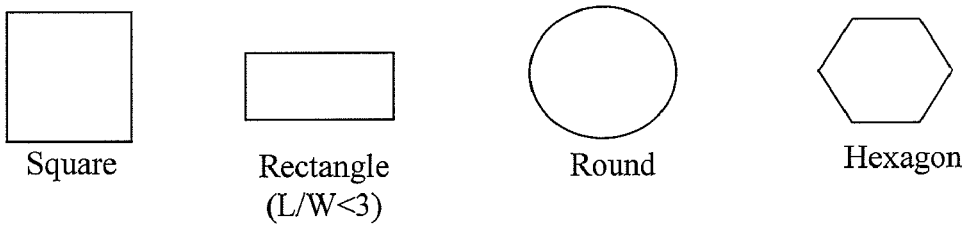
FIG. 2 is a cross-sectional view showing examples of bars of various shapes.
Figure 3:
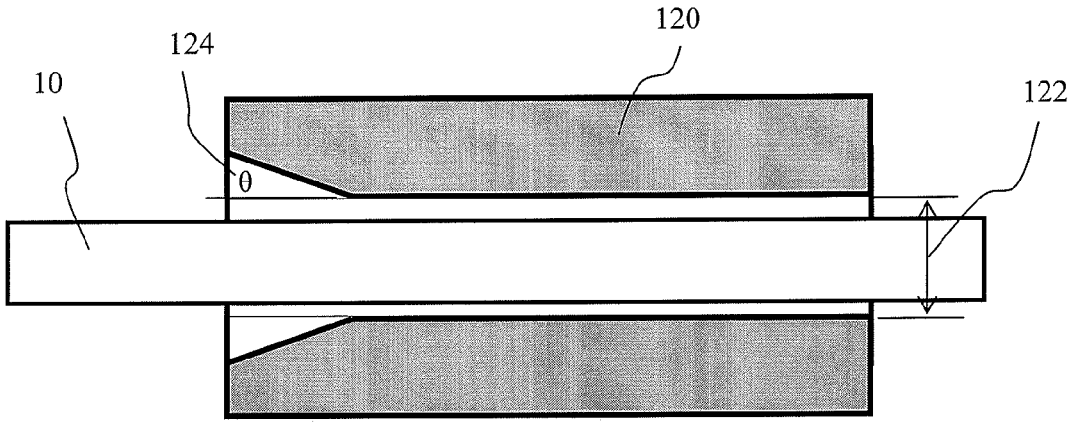
FIG. 3 is a cross-sectional side view of an example of a conventional guide.
Figure 4:
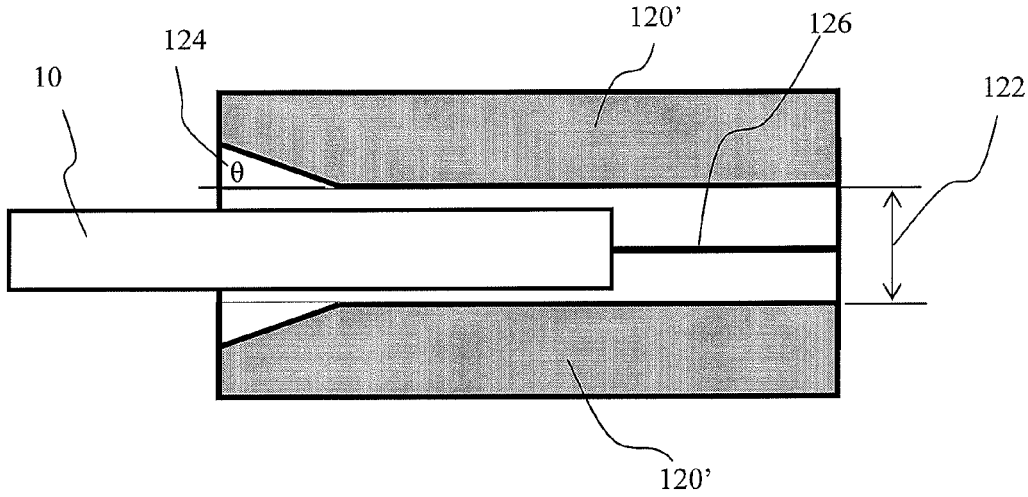
FIG. 4 is a cross-sectional side view of another example of a conventional guide.
Figure 5A:
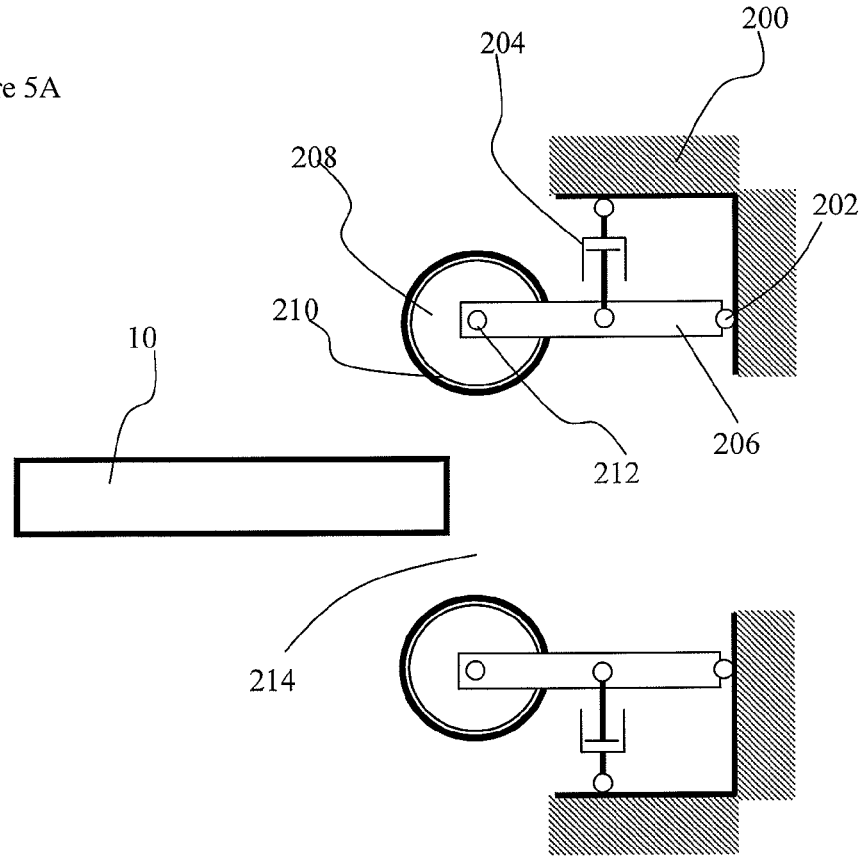
FIGS. 5A-5B are diagrammatic views showing a still further example of a conventional guide.
Figure 5B:
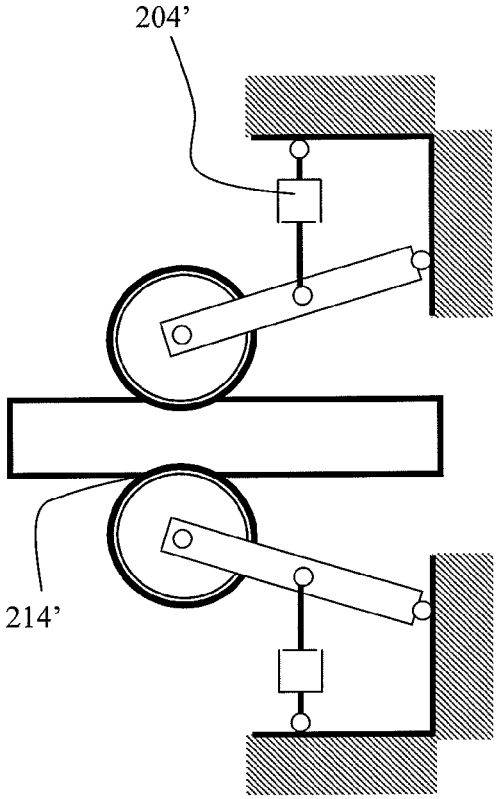

FIG. 1 shows a first, preferred embodiment of the present invention. All items noted in the preferred embodiment design described below may be taken to refer to FIG. 1 unless otherwise specifically stated. The guide illustrated in FIG. 1 is comprised of a combination of two identical mechanisms illustrated by items 50 and 52. The bar (item 10) travels in the direction shown by the arrow (item 12) and is constrained by the guide. FIG. 1 shows the guide's retaining elements, illustrated by items 20 and 20', (herein called the "retaining elements.")

The retaining elements may be in the shape of a full, semi or partial disk. The retaining elements have retaining grooves items 22 and 22' (herein called the "retaining grooves.") machined along their perimeter surfaces. The retaining grooves have variable sized radii. Each retaining element must have enough circular arc length at its perimeter to accommodate machining the intended variable radius range for the retaining grooves. The variable geometry of the retaining grooves is illustrated in item 22 of FIG. 6.

In a second embodiment, the retaining elements may alternatively be a revolver or hub 320 comprised of several independent rollers 322 with variable grooves as shown in FIG. 12). As the hub 320 changes orientation to its arm, or in other words rotates, it also changes the radii of the retaining grooves due to a different set of rollers, having different sized retaining groves, cooperating with each other (FIG. 13).

Combined together as illustrated in FIG. 1, the two retaining grooves form a guidance path that acts to constrain the motion of the bar to the desired bar path.

The variable radii of the retaining grooves in this preferred embodiment are designed so they increase continuously from a point of origin to an end point. Those skilled in the art shall know that they need not necessarily increase continuously from a point of origin to an end point. The radii of the retaining grooves can be determined for every location along the retaining grooves.

Adding the radii of the retaining grooves together at each particular orientation of the retaining elements enables one to calculate the diameter of the guidance path formed by the retaining elements at each such orientation.

Each retaining element is attached to a support assembly, formed by items 30 and 32 (the "support assembly"). Each retaining element can rotate about its center. The center is illustrated as item 26. The center contains an axle, such as a pin or a shaft, to support the retaining element. The axle can be manually turned or can be driven by a motor. Rotating the retaining elements by turning the axle causes the radii of the retaining grooves to change. Changing the radii of the retaining grooves causes the diameter of the guidance path to change. Thus, to change the diameter of the guidance path to a desired size, one merely rotates the retaining elements to the appropriate orientation where the sum of the radii of the retaining grooves forms a guidance path with the desired diameter.

The guide invented and described herein can be used for different diameter bars without the need to physically exchange guides or use guides that do not provide adequate functionality. Simply rotating the retaining elements to the orientation that will optimally match the diameter of the guidance path with the diameter of the bar being processed provides a guide with all the functionality required. Such rotation can be accomplished manually or through automatic control.

The orientation of the retaining elements can be fixed by a locking mechanism in order to maintain the desired diameter match between the bar and the guidance path during the period that the bar moves through the guide. Those skilled in the art shall know that such locking can be accomplished by either locking the retaining elements or by locking the axle of each retaining element.

Those skilled in the art shall also know that rotation of the retaining elements can be accomplished either by putting the actuating force directly onto the retaining elements or by applying it to the axle (item 26).

To prevent the bar from physically contacting the retaining grooves, a medium such as compressed air is delivered through openings in the retaining grooves to the contact area between the bar (item 10) and the retaining grooves (items 22 and 22'). The air is delivered to the openings through piping or channels in the retaining element support assembly, formed by items 30 and 32 (the "support assembly"). The air and the retaining grooves act together to create an air bearing (the "air bearing") to support the bar as it passes through the guide. The air bearing prevents the bar from physically contacting the surface of the retaining elements.

Those skilled in the art shall know that the compressed air piping can be either flexible or fixed and can be composed of metal or plastic materials. Those skilled in the art shall also know that the medium can be other types of fluid such as water or oil.

The support assembly can be attached to an actuator (item 34) such that the retaining elements can be automatically disengaged from the bar path and then engaged to the bar as the leading end enters the guide.

In some cases it might be desirable to control or dampen the vibrations of the bar as it moves along the bar path. Doing so might stabilize the bar so that sensors may operate more effectively and/or cobbles may be avoided. If so desired, as an alternative to a fixed mounting system, the support assembly could incorporate a vibration damping mechanism (the "damping mechanism"), as illustrated in item 40. The damping mechanism could be adjustable to deal with various vibration control needs. Those skilled in the art shall know that the damping mechanism can be comprised of various components. For instance, the damping mechanism could be a simple combination of a spring and a damper, with the spring coefficient and the damping coefficient capable of being adjusted by the operator. The damping mechanism could also be an active vibration-damping device, such as a piezoelectric device designed to automatically react to the vibration motion and provide energy dissipation to dampen the vibration of the bar.

Figure 6:
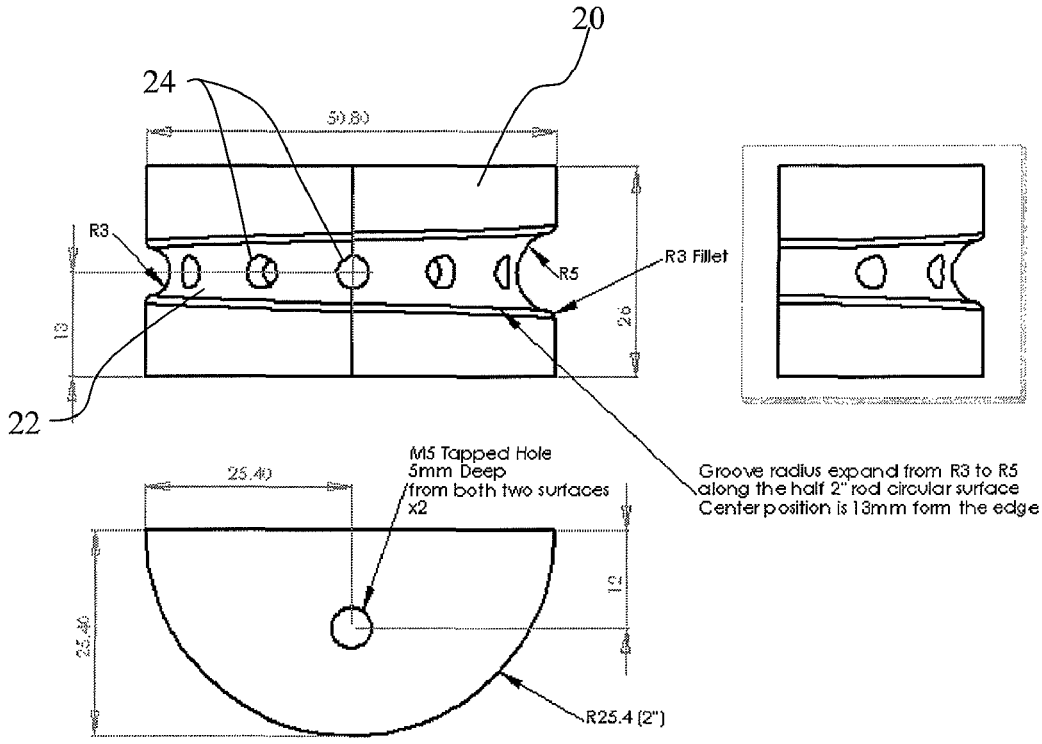
FIG. 6 is combination view showing, in a first embodiment, a top surface of a retaining element (item 20) showing (a) a retaining groove (item 22) where the radii of the retaining groove increases in size from the left side (R3) to the right side (R5) of the retaining groove and (b) the openings (item 24) in the retaining groove (item 22) to allow air or other media to enter the guide path.

FIG. 6 is an implementation example of the retaining elements (item 20). In this example, a retaining groove with a continuously variable radius ranging from 3 mm to 5 mm is implemented. In this case, the variable radius is implemented with a linear, continuous variability. Those skilled in the art shall know that the variable radius can be non-linear and the variable radius can be non-continuous (such as discrete). In this figure, the air path (item 24) is implemented as multiple outlets. Each of the outlets can be individually controlled to selectively open or shut the outlet to achieve the desired airflow. In this implementation, only one air outlet is open to deliver the best air bearing effect.

Figure 7:
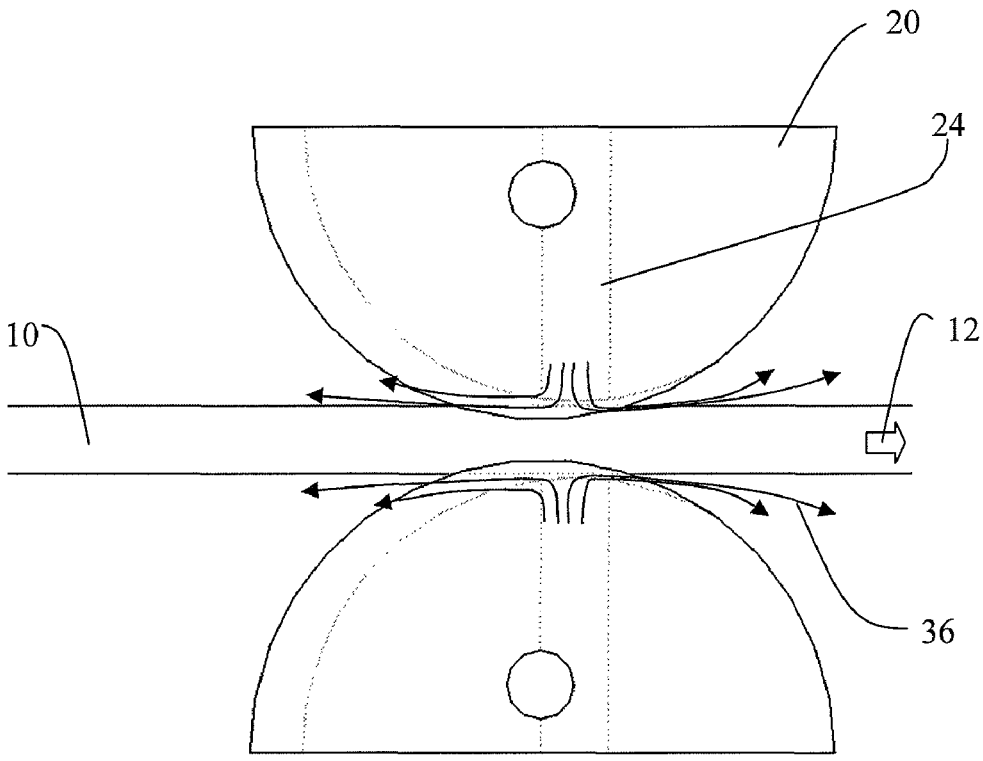
FIG. 7 is a side view showing, in a first embodiment, the air flow (item 36) forming an air bearing to support the bar (item 10) moving through the guide path formed by two retaining elements (item 20) where the air path outlet (item 24) is approximately perpendicular to the bar.

FIG. 7 shows that the airflow (item 36) can be evenly distributed when the outlet is perpendicular or nearly perpendicular to the bar (item 10) surface. However, such perpendicularity is not necessary.

Figure 8:
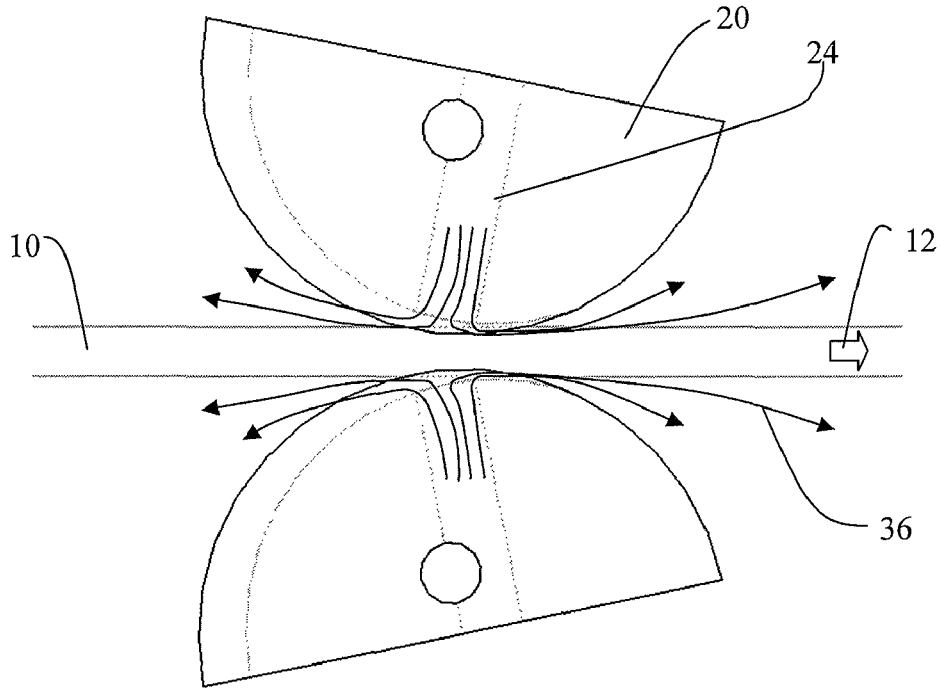
FIG. 8 is a side view showing, in first embodiment, how the retaining elements (item 20) in a first orientation in FIG. 7 have been rotated to a second orientation so that the air path outlets (item 24) for the air flow (item 36) are oriented at a non-perpendicular angle to the bar (item 10).

FIG. 8 illustrates that the airflow (item 36) will still be distributed evenly when the air path (item 24) is tilted toward the side of the bar (item 10) approaching the air path. This even air distribution is due to the effects of the drag on the airflow created by the linear motion of the bar.

Figure 9:
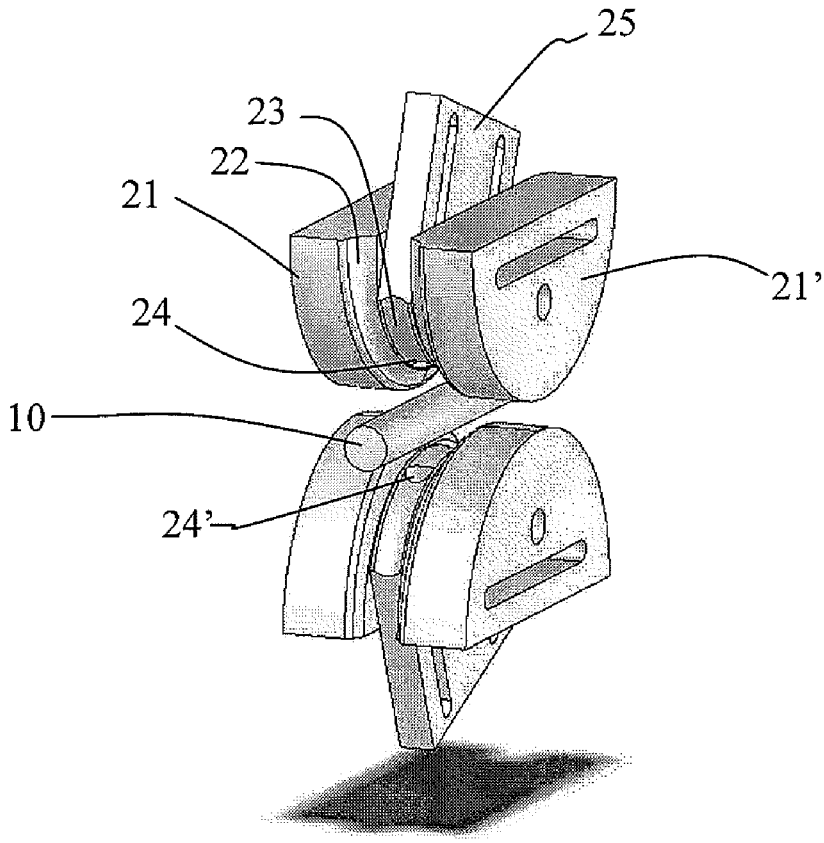
FIG. 9 is a perspective view showing, in a first embodiment, the air path (item 24) in the centerpiece shown as item 25 where the retaining element (item 20) is composed of three separate elements including two similar pieces (items 21 and 21') and a centerpiece (item 25).

FIG. 9 shows another implementation in which the retaining element (item 20) is composed of three separate pieces: two matching pieces, items 21 and 21' and a centerpiece shown as item 25 (the "centerpiece"). The centerpiece is contiguous to items 21 and 21" and contains the air path (item 24). The centerpiece has a partial retaining groove, item 23, which joins continuously and smoothly with the partial retaining grooves on pieces 21 and 21' to form a unitary retaining groove. In this implementation, pieces 21 and 21' can rotate independent of piece 25 such that the air path (item 24) can be pointed in a direction that is different than the orientation of pieces 21 and 21'. This design allows the user the flexibility to adjust the air path for the best air bearing effect, given a particular bar diameter and bar speed.

FIG. 10 illustrates how the retaining elements, items 20 and 20' can be open, i.e. disengaged from the bar path when the leading end of the bar (item 10) is approaching the guide. In this case, the actuator (item 34) could retract the retaining elements, such that the opening (item 14) formed by the retaining elements is made larger when the arrival of the leading end of the bar is imminent. Once the leading end of the bar is in the guide, the actuator can return the retaining element to a predetermined position in order to engage the retaining elements with the bar.

Figure 11:
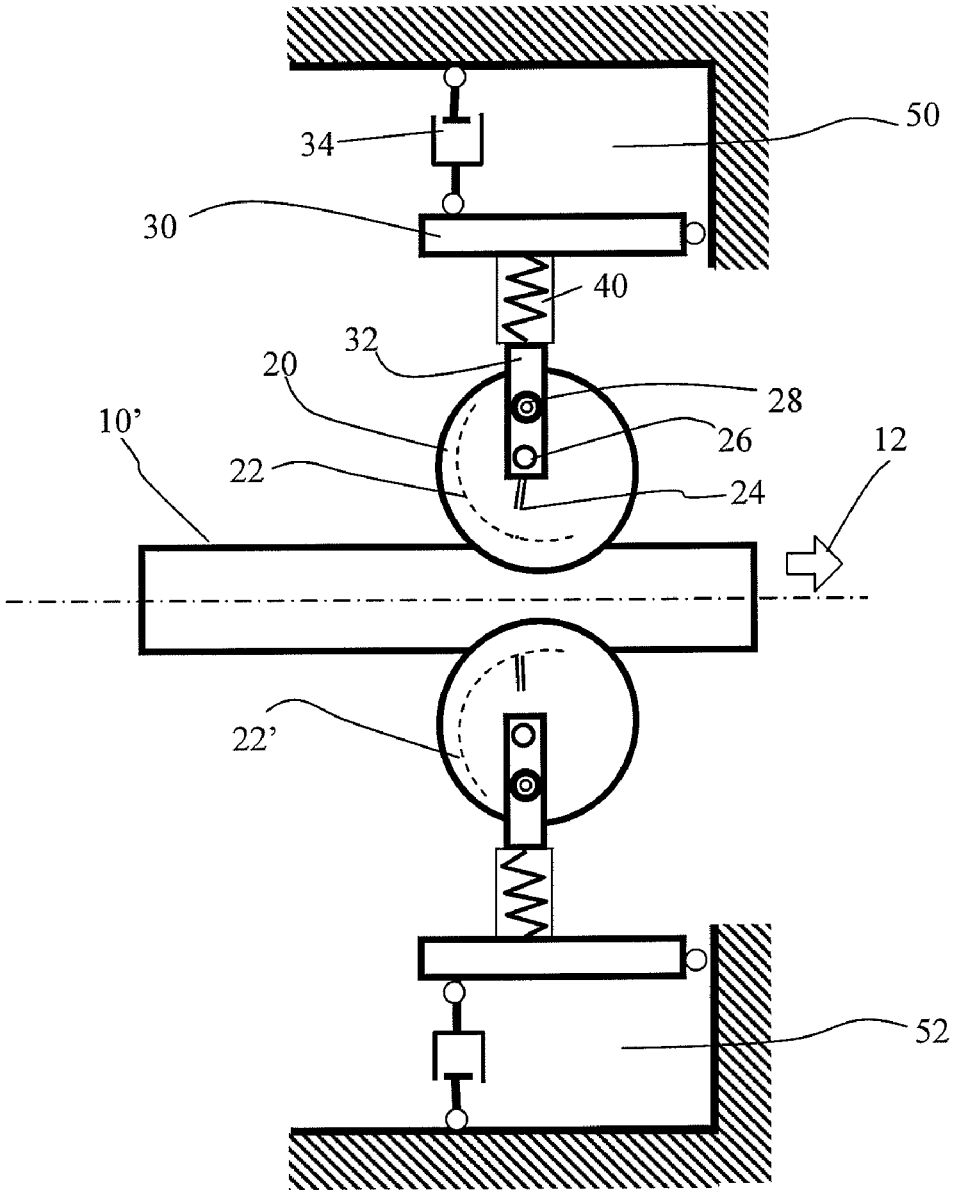
FIG. 11 is a cross-sectional side view showing, in a first embodiment, how the retaining elements 22 and 22' have been rotated to increase the radii of their retaining grooves and hence the diameter of the guide path in order to match a bar with a larger diameter than the bar shown in FIG. 1.

FIG. 11 shows a bar with a larger diameter than the bar in FIG. 1 and illustrates how the retaining elements (items 20 and 20') have been rotated to match the diameter of the guidance path to the diameter of the bar being rolled. FIG. 11 shows that the retaining elements have been rotated to an orientation such that the radii of the retaining grooves (shown by the dotted line labeled 22 and 22') are larger than the radii of the retaining grooves shown by the dotted line labeled 22 and 22' in FIG. 1.

Figures 12A, 12B:
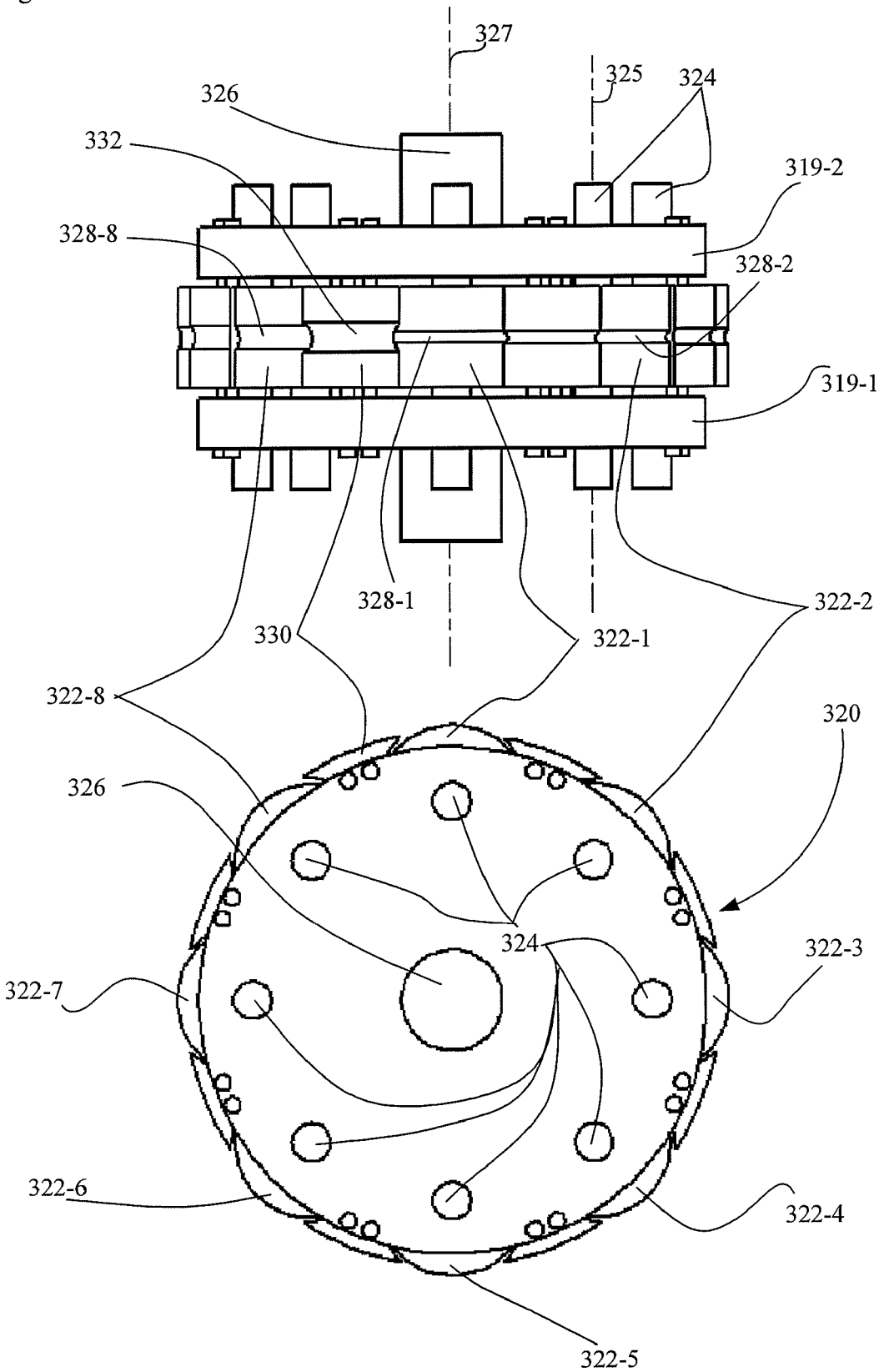
FIGS. 12A-12B are top and side views showing, in a second (revolver) embodiment, how (a) the retaining elements are revolvers comprised of small rollers with variable, increasing groove radii and (b) between rollers, there are fixed guide elements with fixed or variable guide channels or grooves to prevent the bar from falling out while switching between rollers of different sizes.
Figure 13:
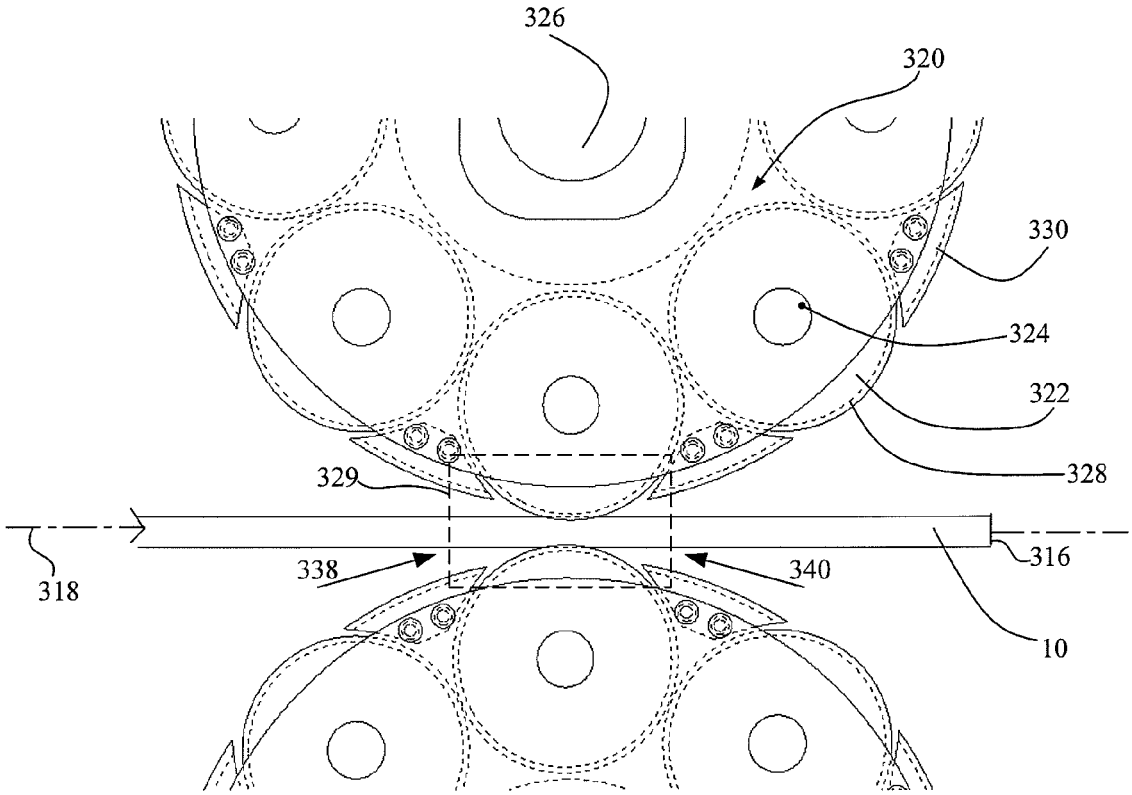
FIG. 13 is a side view showing, in a second embodiment, a pair of rotary hubs confining a bar within their grooves while the bar moves.
Figure 14:
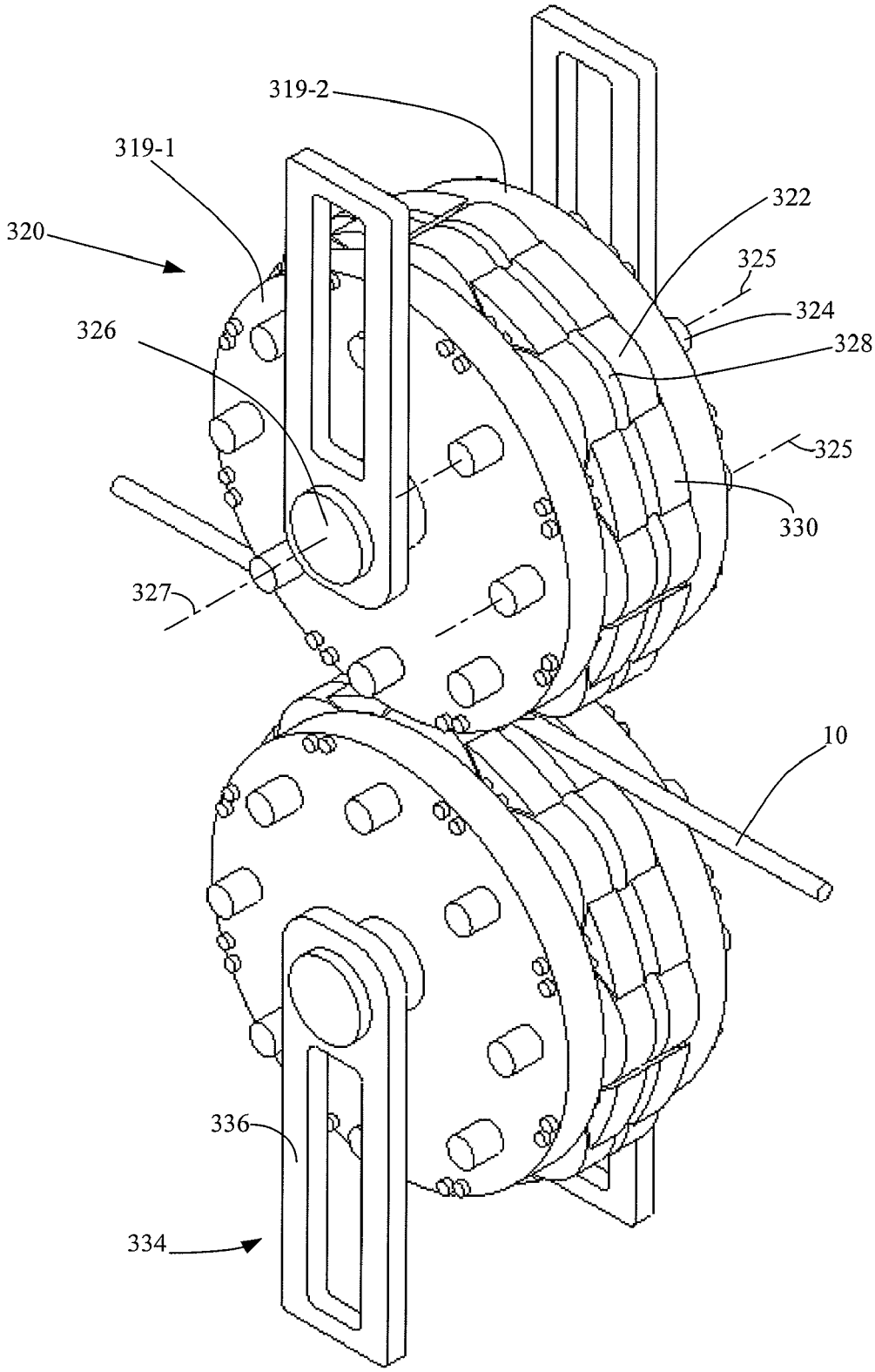
FIG. 14 is a perspective view showing, in a second embodiment, a pair of hubs oriented with respect to each other to form a guideway for controlling the lateral motion of a moving bar.

FIGS. 12-14 show a second embodiment of the present invention. One of ordinary skill in the art may appreciate that there might be cases in which using a fluid bearing layer is less preferred than using actual rolling elements. Accordingly, a different implementation of the retaining element is shown.

FIGS. 12A-12B are top and side views respectively of a revolver type apparatus for capturing a free, approaching end 316 (best shown in FIG. 13) of a metal bar 10 (best shown in FIG. 13) as it moves along a guidance path 318 (best shown in FIG. 13), and to thereafter control the lateral motion of the metal bar as it moves. In this second embodiment, rollers are used instead of a fluid bearing. As illustrated, a hub 320 includes a first member 319-1 and a second member 319-2, and a plurality of rollers mounted on respective rods 324 or the like (e.g., pins, shafts, etc.) and each are configured to rotate about a respective roller axis 325. Rollers 322 may comprise conventional rollers for implementation of the invention. Circular hub 320 further includes a main axle in the form of a rod 326 or the like where hub 320 is configured for rotation to be rotated with respect to an axis 327. Those skilled in the art will appreciate that hub 320 does not necessarily have to be a full disk. A semi- or partial disk would serve the same purpose.

Along the perimeter of hub 320, the plurality of rollers 322-1, 322-2, 322-3, 322-4, 322-5, 322-6, 322-7 and 322-8, each with a diameter smaller than that of hub 320, are mounted on the hub 320, which as described above are each configured to rotate about respective axes 325. It is preferred, but not necessary, to have these rollers evenly spaced. Those skilled in the art would understand that these rollers could be mechanically bearinged for their free rotation. The number of rollers is dependent upon the needs of the actual application. In the illustrated embodiment, eight (8) rollers are shown in FIGS. 12A-12B, as designated by reference numerals 322-1 and 322-2 to 322-8. Each roller 322 has a respective, generally concave retaining groove 328. In the illustrated embodiment, groove 328 has a constant radius along its rotating perimeter. However, the radii for different rollers are different, incrementally increasing from the first to the last of the rollers. For example, the retaining groove radius of roller 322-1 could be 6 mm. Then, that of the roller 322-2 be 8 mm, then that of the roller 322-3 be 10 mm, and so on (i.e., radii of 12 mm, 14 mm, 16 mm, 18 mm, 20 mm for rollers 322-4, 322-5, 322-6, 322-7 and 322-8, respectively). Thus, the retaining groove radius of the roller 322-8 with the largest groove 328 would be 20 mm. The increments do not have to be a constant from one roller to its adjacent roller. There would exist discrete gaps between two adjacent rollers.

Hub 320 further includes at least one, and in the illustrated embodiment a plurality of non-rotating guiding elements 330, which are used to fill up any gaps between rollers. Guiding element 330 is configured to guide the bar within its guide channel 332 by friction (i.e., in contrast to a fluid bearing). This is acceptable for at least three reasons. One reason is that guide channel 332 on the non-rotating guiding element 330 can be configured with a larger diameter (i.e., larger than the diameter of the metal bar) to allow more room for bar motion and thereby reduce the amount of actual contact. A second reason is that the non-rotating guiding element 330 is in use only during a transition time period when the hub 320 is being rotated for moving from one roller 322 to another. This operation is described in greater detail below in connection with FIG. 15. Therefore, the use of non-rotating guiding element 330 is minimal. A third reason is that the non-rotating guiding element 330 can be made of material that minimize friction-based abrasion to the bar. For instance, the material of nodular graphite cast iron may be used for this purpose.

Notwithstanding the above description of the guide channel 332 where it would be fixed and larger than the metal bar itself, in a preferred embodiment, the guide channel 332 is configured to fit or match the size of the retaining grooves of its two adjacent rollers. That is, the radius of the guide channel 332 of each non-rotating guiding element 330 in an assembly of the retaining element may be unique. Those skilled in the art should also appreciate the possibility of configuring the guide channel 332 of guiding element 330 so as to have a varying radius from one end to another, similar to the size progression shown in FIG. 6, but without the air holes. It is also preferred to have the non-rotating guiding element 330 mounted on the hub 320 such that the outer edge of the non-rotating guiding element 330 complements the rollers 322 to form a circular contour. This circular contour provides a smooth transition and provides for an improved retaining function during rotation of hub 320.

FIG. 13 is a side view of a pair of hubs 320 in cooperating relation with each other. The invention as described above for the first embodiment includes a mounting system 334 (best shown in FIG. 14) configured to support the pair of hubs 320, and further configured to allow the hubs to be rotated between various positions. In each of the various positions, each hub 320 is rotated so that rollers from each hub having the same size grooves are aligned with and oppose each other. In this opposed orientation, the retaining grooves form a guideway 329 having a particular diameter. Guideway 329 is enclosed in dashed-line format in FIG. 13. A guidance path 318 extends through guideway 329. Guideway 329 also has an entry end 338 where a free, leading end 316 of bar 10 enters the guideway. Guideway 329 also has an opposite, exit end 340 where the bar 10 emerges. In the embodiment where rollers 322 on each hub have various, different sized retaining grooves, it should be appreciated that the hubs can be rotated to any one of first, second, third, etc. positions so as to form a guideway having a selected, desired size, either for performing a bar-capturing function, or for matching the diameter of the metal bar itself.

FIG. 14 is a perspective view of the second embodiment of the present invention, showing in greater detail the pair of hubs 320 being arranged to cooperate with each by virtue of mounting system 334. Mounting system 334 includes at least support forks 336 or the like that are configured to allow each hub 320 to rotate about its respective axis 327. In all other respects, the mounting system 334 for the second embodiment may have the features described above in connection with the first embodiment of the present invention (FIG. 1 and FIGS. 6-11) including the features for rotating the retaining elements (hubs) locking the retaining elements (hubs), etc. FIG. 14 thus illustrates the implementation of two hubs 320 into a complete bar path guide.

Figure 15:
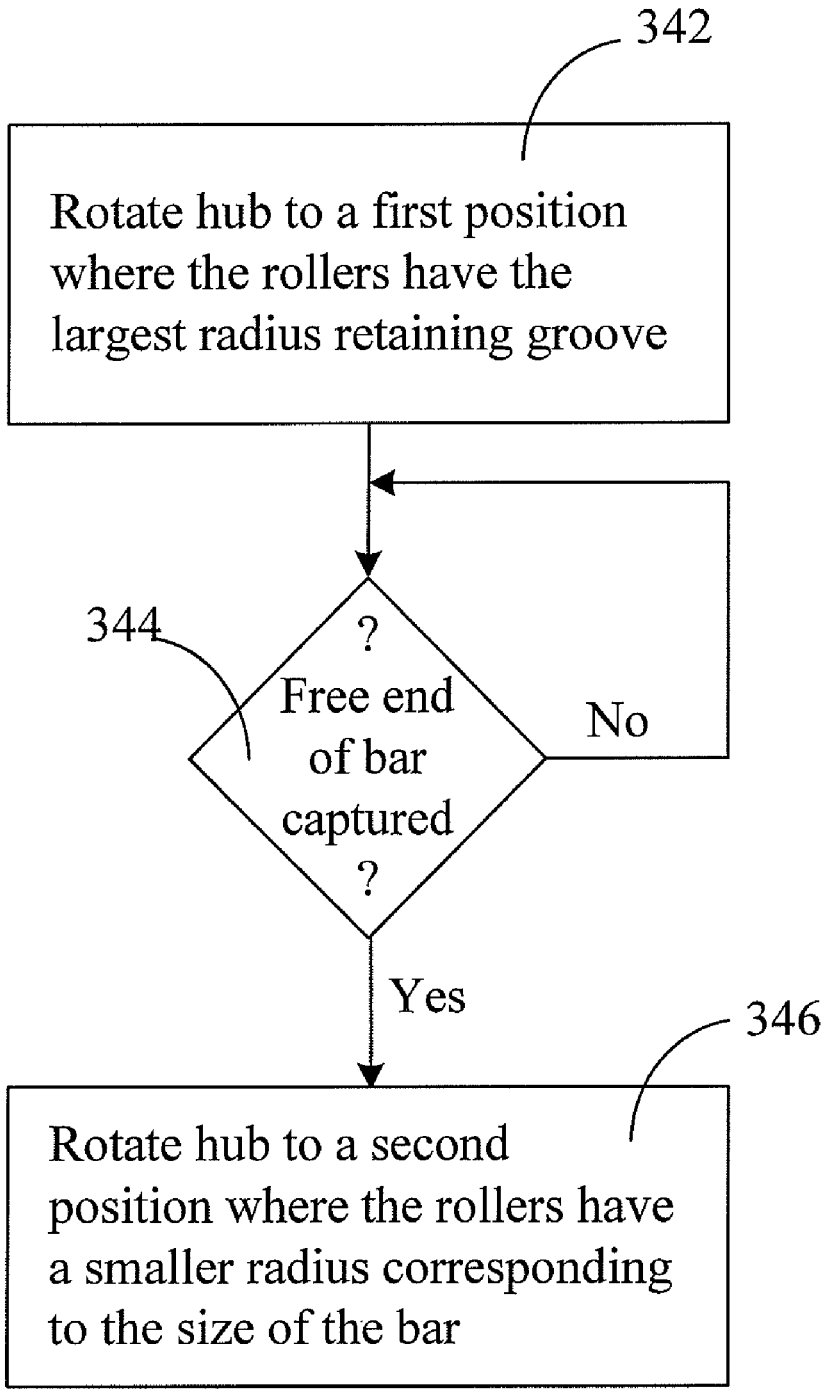
FIG. 15 is a flowchart diagram showing a method of using the revolver guide apparatus of FIGS. 12-14.

FIG. 15 is a simplified flowchart of a method of using the guide apparatus of the second embodiment. The method begins in step 342.

In step 342, the hubs are each rotated to a first position, where respective rollers 322 that have the largest radius are positioned to form the guideway (i.e., are aligned with and oppose each other). This step provides an enlarged opening with which to capture the leading, approaching free end 316 of metal bar 10 as described above. The method then proceeds to step 344.

In step 344, the method determines whether the free end of the bar has been captured by the guide apparatus (i.e., whether end 316 has entered entry end 338 of the guideway 329). This step may be performed manually as per a mill operator, or may be done automatically, as by use of conventional detection components under the control of a main electronic controller (not shown). In either case, if the answer to this decision step is "NO" then the method branches back and step 344 is repeated. This control in effect implements a "waiting" or "dwell" period for the anticipated bar capture event to occur. However, if the answer to this decision step is "YES", then the method proceeds to step 346.

In step 346, the apparatus is configured to rotate the hubs 320 to a second position where the respective rollers have a retaining groove that is smaller in size than that used for the capturing step and which corresponds in size to the actual size of the metal bar. Step 346 may be implemented by causing each hub 320 to rotate so that the desired rollers are each aligned with and oppose each other to form a guideway (e.g., as shown in FIG. 13). In the process of performing this rotating step 346, intermediate positions for the hubs will be transitioned through, and such intermediate positions may includes positions where guiding elements 330 on each hub are aligned with and oppose each to form the guideway. In such transition positions, the guide channels 332 of each guiding element 330 cooperate to form the guideway. In these positions, the guideway has a size defined by the combination of radius of the guide channels. It should be appreciated that the transition diameter is in between the size of the guideway when in the first position (i.e., largest diameter) and the size when in the second position (i.e., actual size of the metal bar).

Once step 346 has been performed, the hubs are locked in the second (final) position. The apparatus is then operative to control the lateral (non-axial) motion of the metal bar 10 as it moves along guidance path 318.

One skilled in the art can recognize that an index (the "index") could be developed to correlate precise orientations of the retaining elements with various guidance path diameters. Such an index would simplify the task of determining how to rotate the retaining elements to match the radii of the guidance grooves and hence the diameter of the guidance path to a new bar with a different diameter. For example, if the next bar to be rolled has a diameter of 5.5 mm, the index could tell the user to set the retaining elements at an orientation called, for purposes of this example, "Position 1". Rotating the retaining elements to Position 1, so that the combined radii of their retaining grooves creates a guidance path with a diameter a little larger that 5.5 mm, would be a reasonably simple operation One skilled in the art shall know that the process of engaging and disengaging the guide with the bar path and of selecting the right position and rotating the retaining elements to that position could be automated using electronic controls, computers and appropriate software.

One skilled in the art could also appreciate the alternative to disengaging, by allowing the guide to have a larger aperture for receiving the leading bar end, then move to an appropriate guide path aperture for normal guiding operation.

In sum, the invention has four main features.

First, the guide can be disengaged (moved out of the bar path) until the leading end of the bar is in the guide. Then, the guide will be engaged to the bar. The engaging/disengaging motion can be manually or automatically controlled. Or, the guide can be constantly engaged, yet receiving the leading end of the bar with its maximum aperture. Then, the aperture (diameter of the guiding path) can be manually or automatically reduced to fit the bar diameter for better lateral motion control.

Second, rotating the retaining elements causes the diameter of the guidance path formed by the retaining elements to change. The mill operator, manually or using an actuator device, can rotate the retaining elements to an appropriate orientation where the diameter of the guidance path and the diameter of the product being rolled are matched. The retaining elements can be locked in a fixed position so they will not move as the bar travels through the guides.

Third, in the first embodiment, the retaining groove may be filled with a medium, such as compressed air, that acts as a barrier to prevent the product from physically contacting the surface of the retaining element. In addition, the media may also cool the surface of the retaining element. Or, in the case the revolver implementation of the second embodiment, rollers of various radii may be used as the bearing elements.

Fourth, each retaining element is attached to a mounting system. The mounting system can be either fixed or can be flexible. A flexible mounting system may comprise one or more springs and one or more shock absorbers. The predetermined force neutral position of the flexible mounting system is at the bar path. The flexible mounting system dissipates kinetic energy from the bar's lateral motion, thereby reducing the bar's non-axial motion relative to the bar path.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An apparatus to control the lateral motion of a bar moving along a guidance path, comprising:

a pair of hubs each being configured to be selectively rotatable about a respective main axis, each hub including (i) at least a first roller and a second roller located at predefined locations around said hub, each roller being freely rotatable about a respective roller axis, said first and second rollers having first and second concave retaining grooves on respective perimeters thereof, said first groove having a first radius that is larger than a second radius associated with said second groove and (ii) at least one guiding element located intermediate said first and second rollers having a guide channel extending in the outer surface thereof;

a mounting system configured to support said hubs and further configured to allow said hubs to be rotated between a first position and a second position, wherein in said first position, said first roller on one of said pair of hubs is aligned with and opposes said first roller on the other one of said pair of hubs so that said first retaining grooves thereof form a guideway having a first size through which the guidance path extends, and wherein in said second position, said second roller on one of said pair of hubs is aligned with and opposes said second roller on the other one of said pair of hubs so that said second retaining grooves thereof form said guideway having a second size, said second size being smaller than said first size so as to accommodate different sized bars.

2. The apparatus of claim 1 wherein in a transition position between said first and second positions, said guiding elements on said hubs being aligned with and opposing one another so that said guide channels thereof form said guideway having a transition size.

3. The apparatus of claim 2 wherein said transition size is at least as large as said first size.

4. The apparatus of claim 2 wherein said transition size varies in a substantially uniform manner between said first size and said second size.

5. The apparatus of claim 2 wherein said guiding elements are fixed relative to said hubs.

6. The apparatus of claim 5 wherein said guiding elements comprise material configured to minimize abrasion as the bar moves through said guideway.

7. The apparatus of claim 6 wherein said guiding elements comprise nodular graphite cast iron material.

8. The apparatus of claim 1 wherein said guideway has an entry end at which an approaching, free end of the bar enters while moving along the guidance path and an exit end opposite the entry end, said retaining grooves of said rollers being configured so that said guideway is larger at said entry end when in said first position than at said exit end when in said second position so to allow capture of said approaching, free end.

9. The apparatus of claim 1 wherein each hub comprises:

a first member;

a second member spaced apart from said first member;

an axle extending along said main axis, said first member and second member being attached to said axle for rotation therewith; and wherein said rollers and said guiding elements are disposed between said members.

10. The apparatus of claim 9 wherein said rollers each have a respective rod extending along said roller axis wherein said rod is attached to said first and second members and is configured to permit said rollers to rotate about said roller axes.

11. The apparatus of claim 9 wherein said rollers each have a respective bearing on which said rollers rotate, said bearings being supported by a respective base attached to said first and second members.

12. The apparatus of claim 9 wherein said first and second members comprise discs.

13. The apparatus of claim 12 wherein said discs are full circular shaped discs.

14. The apparatus of claim 1 wherein said first and second rollers are located in said predefined locations so that when said hubs are in said first position, said second rollers do not interfere with said movement of the bar through said guideway formed by said first rollers, and when said hubs are in said second position, said first rollers do not interfere with said movement of the bar through the guideway formed by said second rollers.

15. The apparatus of claim 1 wherein each hub includes a further plurality of rollers and guiding elements, and wherein respective guideways formed by respective sets of rollers each have a different size.

16. The apparatus of claim 15 wherein each one of said plurality of guideways change incrementally in size between adjacent rollers.

17. The apparatus of claim 1 wherein said rollers have a roller outer surface that is cylindrical in shape, said guiding element being configured such that a guiding element outer surface transitions smoothly between roller outer surfaces of said adjacent rollers.

* * * * *